US008336484B2

(12) United States Patent
Wu et al.

(10) Patent No.: US 8,336,484 B2
(45) Date of Patent: Dec. 25, 2012

(54) GLUING MECHANISM

(75) Inventors: Pei-cheng Wu, Tu Cheng (TW); Feng-chi Lee, Tu Cheng (TW); Kuo-chuan Chiu, Tu Cheng (TW); Chia-hsin Liao, Tu Cheng (TW)

(73) Assignee: Cheng UEI Precision Industry Co., Ltd., Tu Cheng, Taipei (TW)

( * ) Notice: Subject to any disclaimer, the term of this patent is extended or adjusted under 35 U.S.C. 154(b) by 232 days.

(21) Appl. No.: 12/850,626

(22) Filed: Aug. 4, 2010

(65) Prior Publication Data

US 2012/0031326 A1 Feb. 9, 2012

(51) Int. Cl.

| | |
|---|---|
| ***B05B 13/04*** | (2006.01) |
| ***B05B 3/00*** | (2006.01) |
| ***B05C 13/00*** | (2006.01) |
| ***B05C 11/00*** | (2006.01) |

(52) U.S. Cl. ..... 118/319; 118/320; 118/416; 118/321; 118/323; 118/712; 118/687; 156/578

(58) Field of Classification Search ..... 118/318, 118/319, 300, 321, 323, 313–315, 305, 410, 118/416, 320, 500, 712, 686, 687; 156/578; 427/424, 427.3

See application file for complete search history.

(56) References Cited

U.S. PATENT DOCUMENTS

| | | | | |
|---|---|---|---|---|
| 5,989,644 | A * | 11/1999 | Williams | 427/424 |
| 6,436,189 | B1 * | 8/2002 | Reuscher | 118/319 |
| 2010/0266780 | A1 * | 10/2010 | Lawrynowicz et al. | 427/446 |

* cited by examiner

*Primary Examiner* — Yewebdar Tadesse
(74) *Attorney, Agent, or Firm* — Cheng-Ju Chiang

(57) ABSTRACT

A gluing mechanism comprising a platform, a plurality of turn tables set on the platform for workpieces, a motor for driving the turn tables and a gluing device firmly set up on the platform. The gluing device comprises a forward assembly, an elevator, a panning assembly and a plurality of glue applicators. The forward assembly is set on the platform and moves along a shorter side of the platform. The elevator is set on the forward assembly and moves relative to the platform vertically. The panning assembly is set on the elevator and moves along a longer side of the platform. The glue applicators are installed on the panning assembly. The motor drives the turn tables simultaneously. The gluing mechanism of the present invention has benefits of simple structure, a high working efficiency and proceeds a precise rotary gluing process to workpieces. Therefore, an excellent gluing quality can be realized.

10 Claims, 6 Drawing Sheets

GLUING MECHANISM

BACKGROUND OF THE INVENTION

1. Field of the Invention

The present invention generally relates to a gluing mechanism, and more particularly to a gluing mechanism having multiple glue applicators.

2. Description of Prior Art

In a traditional rotary gluing process, two sets of platforms are generally utilized for promoting the working efficiency. Each set of platform is equipped one set of gluing device to independently proceed the gluing process respectively. Each set of gluing device comprises a turn table fixed on the platform, a motor for driving the turn table, a glue applicator above the turn table, a glue applicator fixe seat for installing the glue applicator and an elevator installed on the glue applicator fixe seat for moving the glue applicator vertically.

During the gluing process of such a dual-head gluing mechanism, two motors drive the corresponding turn tables respectively to rotate the workpieces on the turn tables in the beginning. Then, two elevators down the respective glue applicators to their locations for gluing according to the respective positions of the workpieces on the turn tables. At last, glue is supplanted from the glue applicators and the gluing process will not stop until all the rotary gluing positions are glued. Then, the gluing process is completed.

However, on the one hand, each turn table needs one responding motor for driving. The gluing mechanism of prior art is not easy for operation and the work efficiency is low. On the other hand, the elevator can merely move the glue applicators up and down (vertically). The location control of the glue applicators has limitation. The location for the glue applicators is not precise enough and consequently inhibits the gluing quality.

SUMMARY OF THE INVENTION

For solving the drawbacks of prior art, a gluing mechanism has a high working efficiency. The gluing mechanism can proceed a precise rotary gluing process to workpieces. An excellent gluing quality can be realized.

The gluing mechanism of the present invention comprises a platform, a plurality of turn tables set on the platform for workpieces, a motor for driving the turn tables and a gluing device firmly set up on the platform. The gluing device comprises a forward assembly, an elevator, a panning assembly and a plurality of glue applicators. The forward assembly is set on the platform and moves along a shorter side of the platform. The elevator is set on the forward assembly and moves relative to the platform vertically. The panning assembly is set on the elevator and moves along a longer side of the platform. The glue applicators are installed on the panning assembly. The motor drives the turn tables simultaneously.

As aforementioned, on one hand, the gluing mechanism of the present invention only needs one motor to drive multiple turn tables to proceed a rotary gluing process to multiple workpieces. The structure of the gluing mechanism is simple and the gluing mechanism has a high working efficiency; on the other hand, the gluing device of the gluing mechanism can proceed a precise location for the glue applicators in three directions. Therefore, an excellent gluing quality can be obtained.

DETAILED DESCRIPTION OF THE INVENTION

Figure 1:
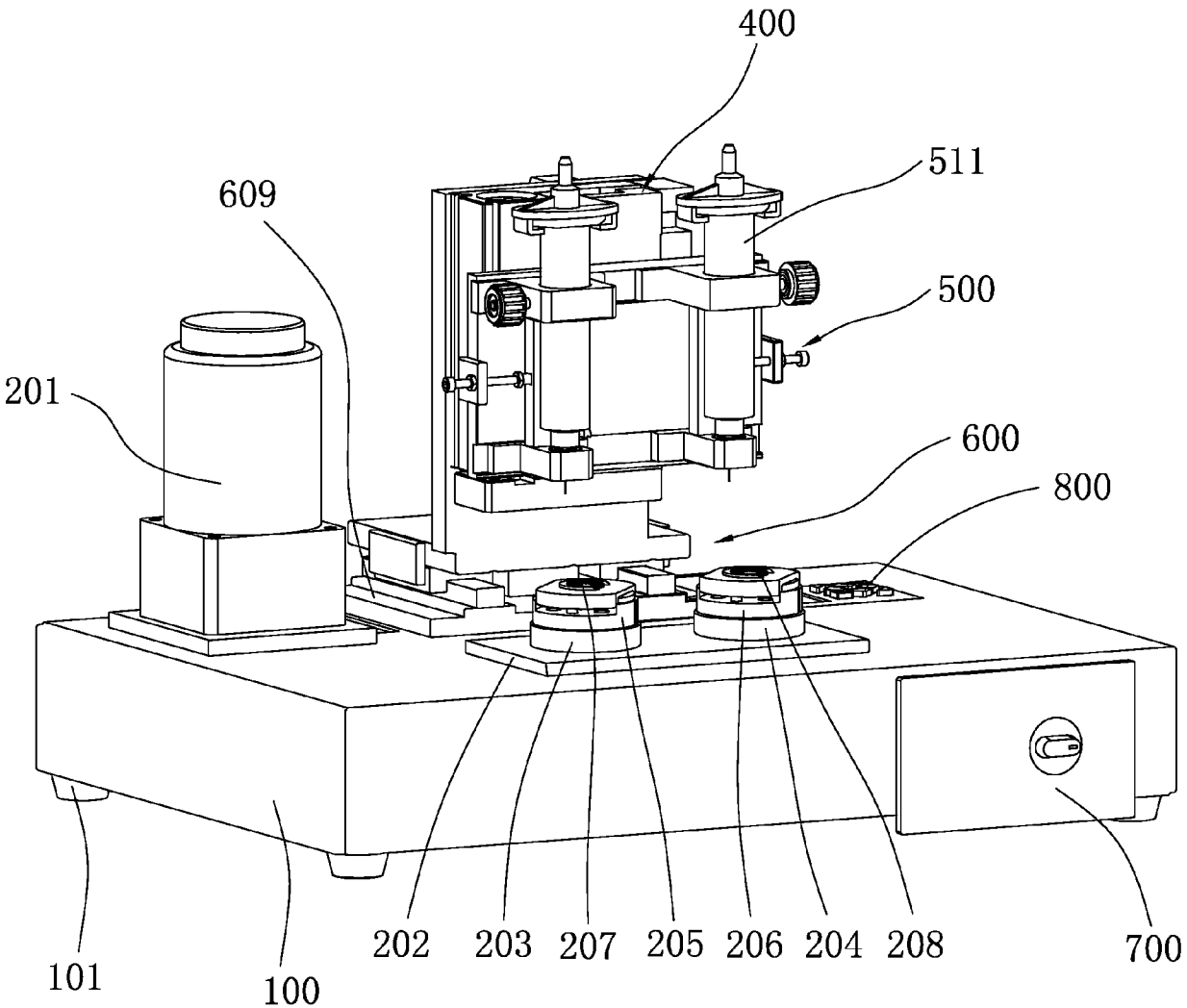
FIG. 1 depicts a three dimensional view diagram of a gluing mechanism according to the present invention.
Figure 2:
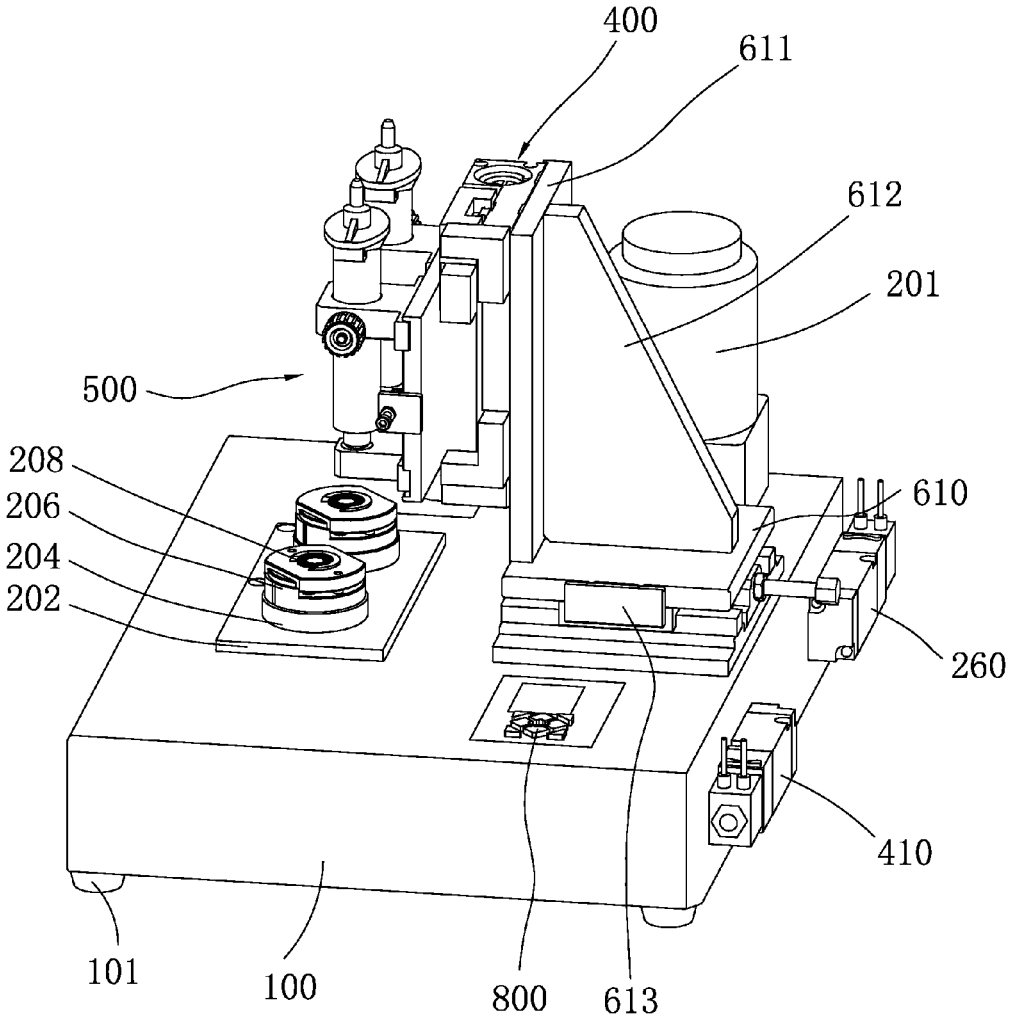
FIG. 2 depicts another three dimensional view diagram of a gluing mechanism according to the present invention.

Please refer to FIG. 1 and FIG. 2. The gluing mechanism of the present invention comprises a platform 100, several supporting legs 101, a motor 201, a turn table fix seat 202, a first turn table 203, a second turn table 204, a first workpiece fix seat, a second workpiece fix seat, a base plate 609, a forward assembly 600, an elevator 400, a panning assembly 500 and two glue applicators 511. In this embodiment, the first workpiece is a first sound membrane 207. The second workpiece is a second sound membrane 208. The first workpiece fix seat is a first sound membrane fix seat 205. The second workpiece fix seat is a second sound membrane fix seat 206. The several supporting legs 101 are installed under the platform 100 for supporting the platform 100.

The first turn table 203 and the second turn table 204 are firmly installed on the turn table fix seat 202. The motor 201 are jointed with the first turn table 203 and the second turn table 204 for driving the first turn table 203 and the second turn table 204 simultaneously. The first sound membrane fix seat 205 and the second sound membrane fix seat 206 are firmly jointed with the first turn table 203 and the second turn table 204. The first sound membrane 207 and the second sound membrane 208 are firmly positioned on the first sound membrane fix seat 205 and the second sound membrane fix seat 206 respectively. The base plate 609 is fixed on the platform 100 and aligned with the turn table fix seat 202. The forward assembly 600 is set on the base plate 609 and can move along a shorter side of the platform 100. The elevator 400 is set on the forward assembly 600 and can move relative to the platform 100 vertically. The panning assembly 500 is set on the elevator 400 and can move along a longer side of the platform 100. The two glue applicators 511 are firmly installed on the panning assembly 500.

Figure 3:
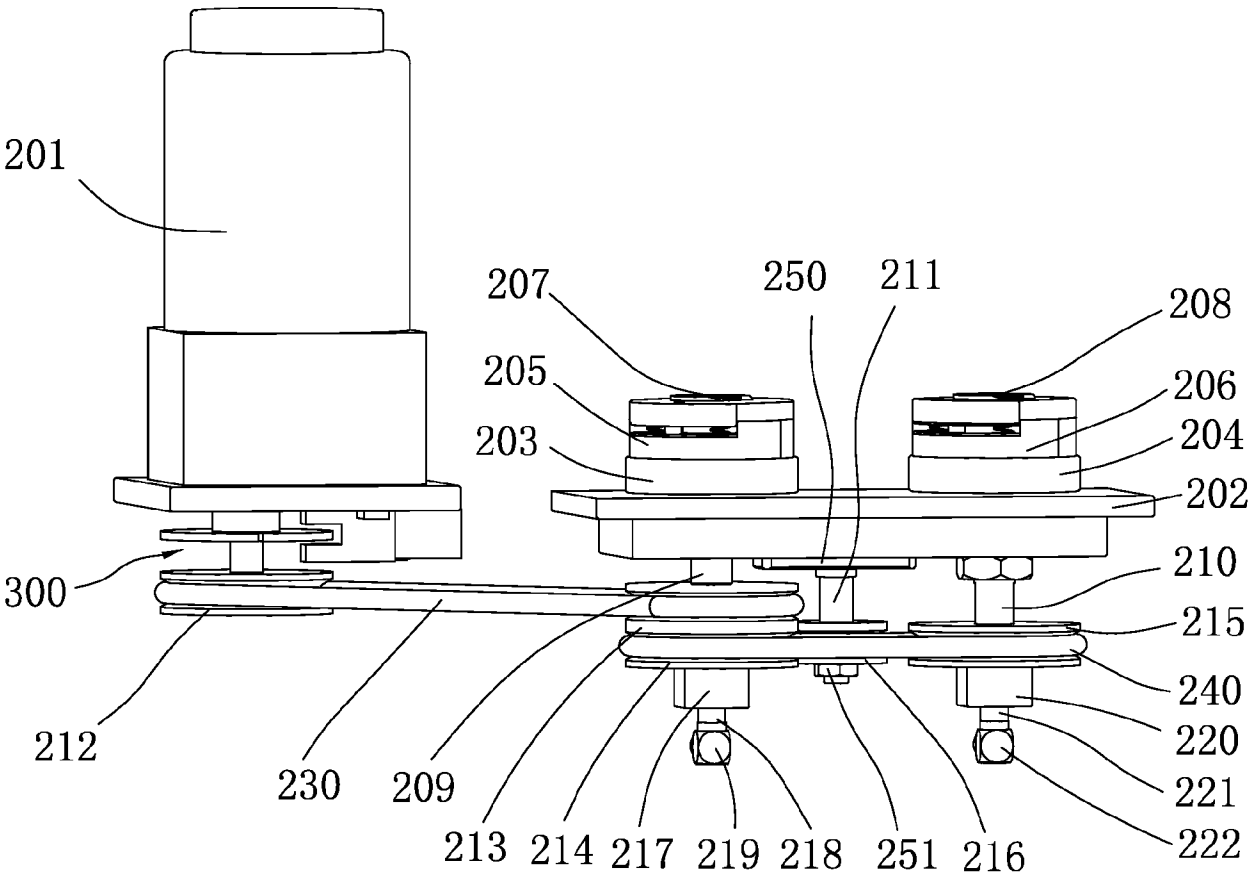
FIG. 3 shows a diagram of the motor and the turn tables of the gluing mechanism shown in FIG. 1.

FIG. 3 shows a diagram of the motor 201 which can drive the first turn table 203 and the second turn table 204 simultaneously. As shown in FIG. 3, the first turn table 203 has a first rotating shaft 209. The second turn table 204 has a second rotating shaft 210. One side of a joint plate 250 is fixed on the platform 100. The other side of the joint plate 250 is jointed with a third rotating shaft 211. An output shaft of the motor 201 is jointed by a first driving pulley 212. The first rotating shaft 209 is jointed by a first driven pulley 213 and a second driving pulley 214 sequentially. The first driven pulley 213 and the second driving pulley 214 are firmly jointed together. A second rotating shaft 210 is jointed by a second driven pulley 215. The third rotating shaft 211 is jointed with a compressing pulley 216. The third rotating shaft 211 is screwed with a locking bolt 251. The locking bolt 251 is positioned under the compressing pulley 216 for locking the compressing pulley 216. The first belt 230 is stretched over the first driving pulley 212 and the first driven pulley 213. The second belt 240 is stretched over the second driving pulley 214 and the second driven pulley 215. The compressing pulley 216 compresses a side of the stretched second belt 240.

Preferably, a first locker 217 can be positioned under the second driving pulley 214 on the first rotating shaft 209. The first locker 217 has a through hole inside for making the first rotating shaft 209 therethrough and locked inside. The first locker 217 has steps inside the through hole. The first column 218 has a flange and the diameter of the first column 218 is smaller than that of the through hole of the first locker 217. The flange of the first column 218 can match with the steps of the first locker 217 and allow the first column 218 to be sleeve jointed inside the first locker 217. Meanwhile, a gap exists between the surface of the first column 218 and the first locker 217. Therefore, as the first locker 217 is rotated with the first rotating shaft 209, the first column 218 remains static. The first column 218 has an inside pipe. One end of a first suction inlet 219 is fixed with the first column 218, and the other end of the first suction inlet 219 is connected to the vacuum pump (not shown).

Preferably, the gluing mechanism further comprises a first pressure control valve 260 which is firmly connected to the vacuum pump (not shown) and control the pressure thereof. Similarly, a second locker 220 can be positioned under the second driven pulley 215 on the second rotating shaft 210. Under the second locker 220, there will be second column 221 and second suction inlet 222 to be sleeve jointed sequentially. The way of joint is same as the first locker 217, the first column 218 and the first suction inlet 219.

Figure 4:
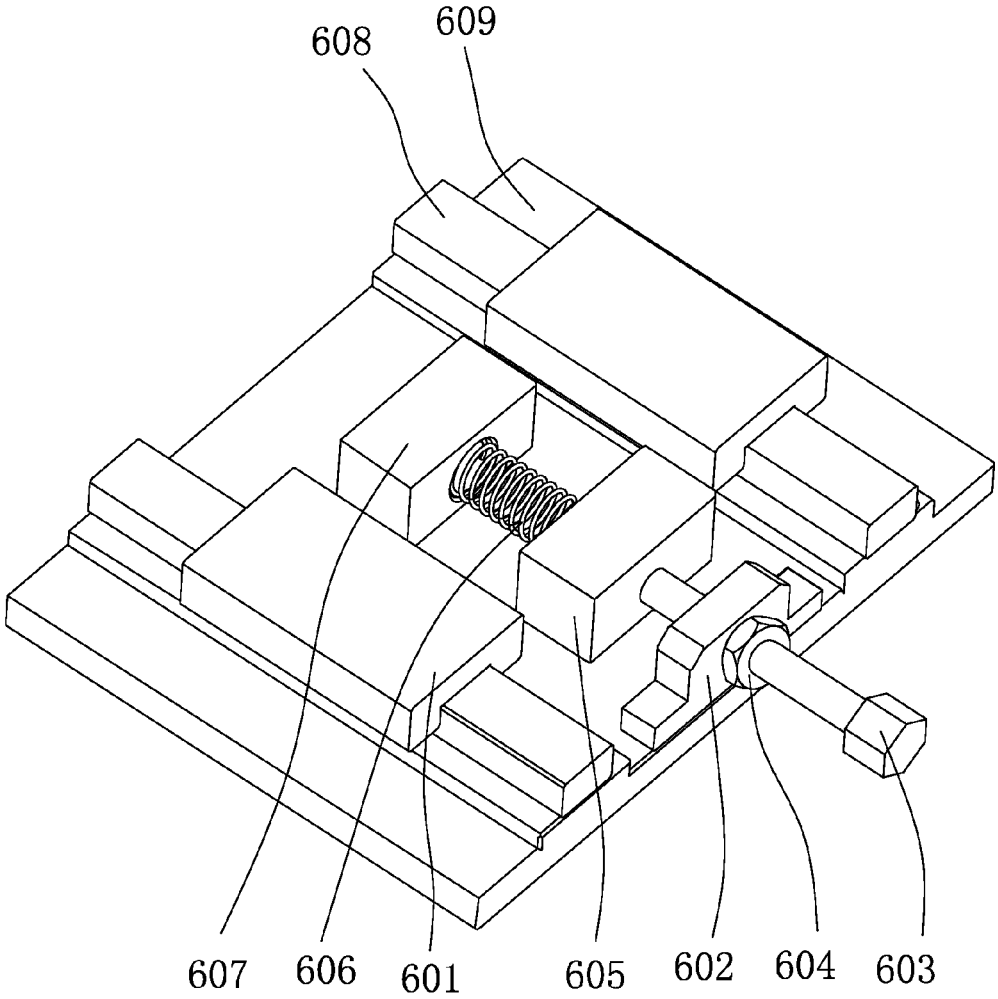
FIG. 4 shows a diagram of the forward assembly and the base plate of the gluing mechanism shown in FIG. 1 without the standing plate and the plate.

Please refer to FIG. 1, FIG. 2 and FIG. 4. The forward assembly 600 comprises a sliding block 601, a blot fix block 602, a bolt 603, a fix screw 604, a first joint block 605, an elastic element 606, a second joint block 607, a substrate 610, a standing plate 611, a supporting plate 612 and side plates 613. The substrate 610 is firmly jointed with the sliding block 601 with two side plates 613. The standing plate 611 is fixed with the substrate 610 vertically. The supporting plate 612 is fixed with the standing plate 611 and the substrate 610 respectively for supporting the standing plate 611. The sliding tracks 608 are parallel positioned on the base plate 609. The blot fix block 602 is fixed on the base plate 609. The bolt 603 is screwed through both the bolt fix block 602 and the fix screw 604. One end of the bolt 603 is screwed through the fix screw 604 and the bolt fix block 602 in orders and to firmly joint with the first joint block 605. Preferably, a stop screw (not shown) is connected with the inside thread of the first joint block 605. The stop screw connects the thread of the bolt 603 and can stop the bolt 603 for stopping the sliding block 601. One end of the elastic element 606 presses against the first joint block 605 and the other end of the elastic element 606 presses against the second joint block 607. The sliding block 601 joints the substrate 610 with the side plates 613 and therefore fixed with the elevator 400. The first joint block 605 is fixed with the substrate 610 and therefore fixed with the elevator 400. The elevator 400 slidably joints the base plate 609 along the slide track 608.

Figure 5:
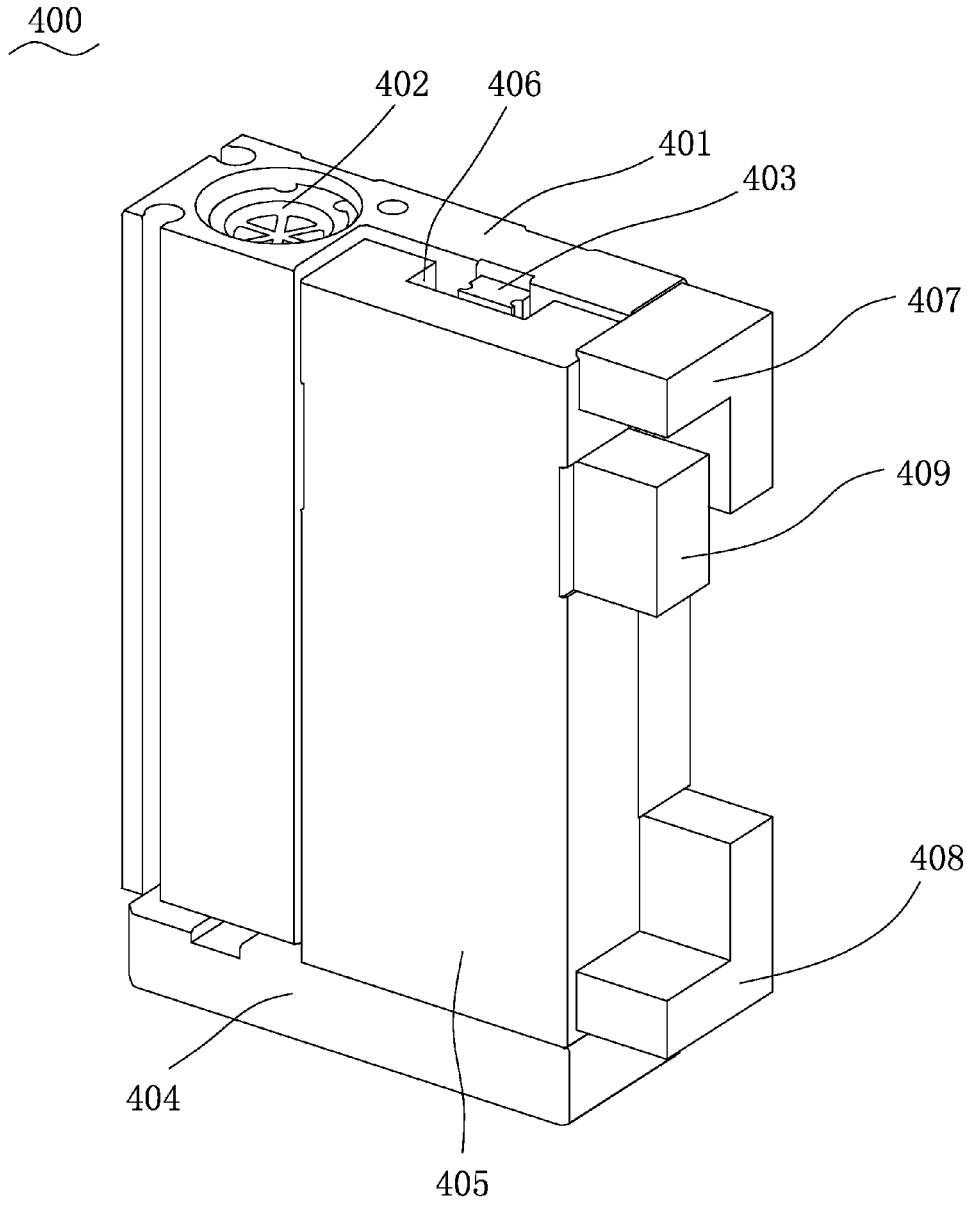
FIG. 5 shows a diagram of an elevator of the gluing mechanism shown in FIG. 1.

Please refer to FIG. 1, FIG. 2 and FIG. 5. The elevator 400 comprises a cylinder base 401, a cylinder 402, a guide 403, a middle plate 404, a slide plate 405, a first slideway 406, an upper block 407, a lower block 408 and a stopper 409. One side of the cylinder base 401 is fixed on the standing plate 611. The cylinder 402 is firmly installed on the cylinder base 401 vertical to the platform 100. The cylinder base 401 has a guide 403 parallel with the cylinder 402. The middle plate 404 is firmly connected to the piston rod of the cylinder 402. One end of the slide plate 405 is firmly connected with the middle plate 404. The side of the slide plate 405 facing the cylinder base 401 has the first slideway 406. The first slideway 406 of the slide plate 405 matches with the guide 403 to allow the slide plate 405 to slide on the cylinder base 401 along the guide 403. The stopper 409 is located at the other end of the slide plate 405 away from the cylinder 402. The upper block 407 and the lower block 408 are located at the other end of the cylinder base 401 away from the cylinder 402 for limiting the movement of the stopper 409. Preferably, the gluing mechanism further comprises a second pressure control valve 410 is firmly connected to the cylinder 402 for controlling the pressure of the cylinder 402.

Figure 6:
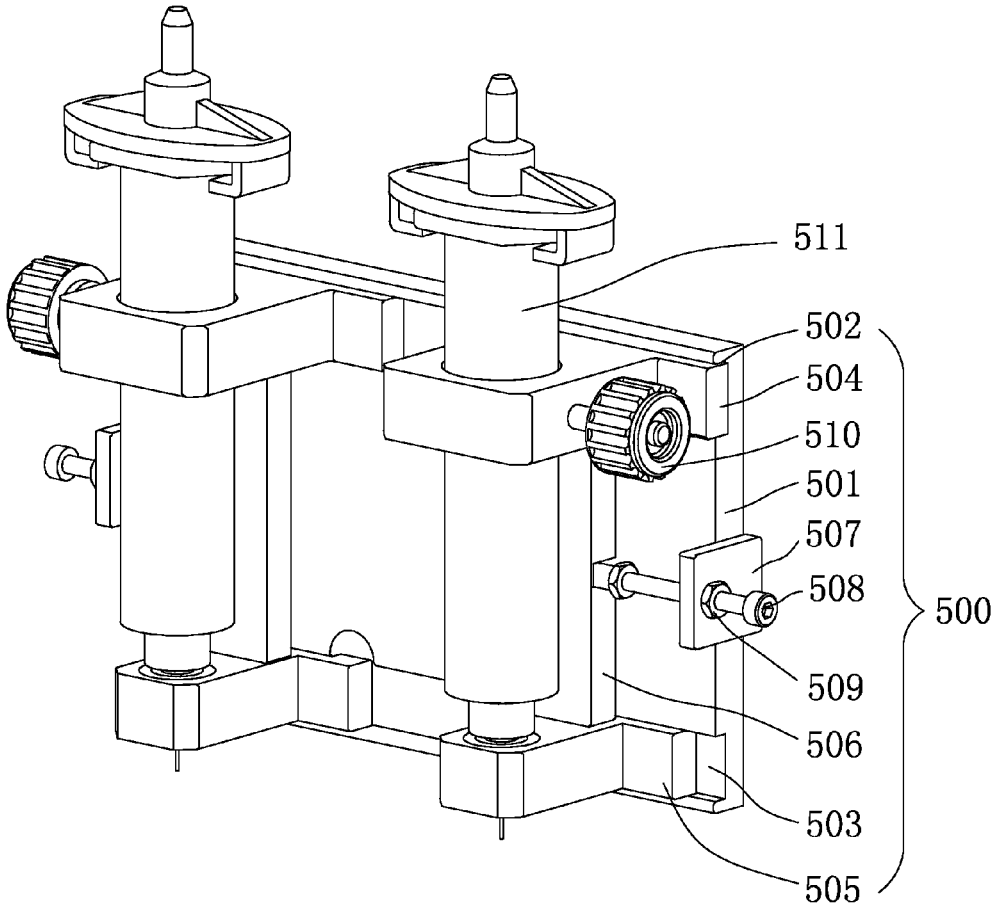
FIG. 6 shows a diagram of the panning assembly and the glue applicators shown in FIG. 1.

Please refer to FIG. 5 and FIG. 6. The panning assembly 500 comprises a glue applicator conveyer 501, two upper fix blocks 504, two lower fix blocks 505, two connection columns 506, two adjustment bases 507, two adjustment bolts 508, two fasten screws 509 and two fix bolts 510. One side of the glue applicator conveyer 501 is firmly jointed with the slide plate 405. A second slideway 502 and a third slideway 503 are parallel with each other and set on the other side of the glue applicator conveyer 501 horizontally. Two ends of each connection column 506 are fixed with one upper fix block 504 and one lower fix block 505. The upper fix blocks 504 and the lower fix blocks 505 slidably joint with the glue applicator conveyer 501 along the second slideway 502 and the third slideway 503. The two adjustment bases 507 are firmly set at two sides of the glue applicator conveyer 501 respectively. The adjustment bolts 508 are screwed through the fasten screws 509 and the adjustment bases 507. One end of each adjustment bolt 508 is screwed through the fasten screw 509 and the adjustment base 507 to be fixed with one connection column 506. The glue applicators 511 are through the upper fix blocks 504 and the lower fix blocks 505 and to be set therebetween. The fix bolts 510 are screwed through the upper fix blocks 504 and one end of each fix bolt 510 presses against the glue applicator 511. With unloosening the fix bolts 510, the glue applicators 511 can be replaced with new ones and keep the new ones in the regular positions of the glue applicators 511.

Preferably, the gluing mechanism of the present invention further comprises a rotation sensor 300 and a controller 800. The rotation sensor 300 is rotatably jointed with an output shaft of the motor 201. The rotation sensor 300 and the motor 201 are both electrically connected to the controller 800. The controller 800 receives the rotation signals from the rotation sensor 300 and to control the RPM of the motor 201 thereby.

Preferably, the gluing mechanism of the present invention further comprises a reducer 700. The reducer 700 is electrically connected to the motor 201 and to control the RPM of the motor 201 thereby.

Please refer to FIG. 1~FIG. 6. A detail working theory of the gluing mechanism of the present invention is introduced hereafter. First, the first sound membrane 207 and the second sound membrane 208 are firmly put into the first sound membrane fix seat 205 and the second sound membrane fix seat 206. Then, the vacuum pump is activated for sucking the first sound membrane 207 and the second sound membrane 208 tight on the first sound membrane fix seat 205 and the second sound membrane fix seat 206 to prevent the first sound membrane 207 and the second sound membrane 208 hurled away during the rotation. And then, the bolt 603 can be adjusted to move the slide block 601 to align the glue applicators 511 above the first sound membrane 207 and the second sound membrane 208. The second pressure control valve 410 is then calibrated for controlling the cylinder 402 and to make the glue applicators 511 go down to the surfaces of the first sound membrane 207 and the second sound membrane 208. Then, the adjustment bolts 508 can be fine tuned to move the glue applicators 511 horizontally and precisely locate to any points on the surfaces of the first sound membrane 207 and the second sound membrane 208. At this moment, glue is supplanted from the glue applicators 511. Meanwhile, the motor 201 is activated to rotate the first turn table 203 and the second turn table 204 which are carrying the first sound membrane 207 and the second sound membrane 208 for proceeding the rotary gluing process to the first sound membrane 207 and the second sound membrane 208 through.

As aforementioned, on one hand, the gluing mechanism of the present invention only needs one motor to drive multiple turn tables to proceeds a rotary gluing process to multiple workpieces. The structure of the gluing mechanism is simple and has a high working efficiency; on the other hand, the gluing device of the gluing mechanism can proceed precise location for the glue applicators in three directions. Therefore, a great gluing quality can be obtained.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. A gluing mechanism, applied in a rotary gluing process, comprising:

a platform;

a plurality of turn tables, set on the platform for workpieces, and wherein two of the plurality of turn tables have a first rotating shaft and a second rotating shaft, respectively;

a motor, driving the turn tables; and a gluing device, firmly set up on the platform and having a forward assembly, an elevator, a panning assembly and a plurality of glue applicators;

wherein the forward assembly is set on the platform and moves along a shorter side of the platform, the elevator is set on the forward assembly and moves relative to the platform vertically, the panning assembly is set on the elevator and moves along a longer side of the platform, the glue applicators of the gluing device are installed on the panning assembly and the motor drives the turn tables simultaneously, and the gluing mechanism further comprises a first driving pulley, a first driven pulley, a second driving pulley, a second driven pulley, a compressing pulley, a first belt, a second belt, a third rotating shaft, wherein the third rotating shaft is fixed on the platform, and the first rotating shaft is jointed with an output shaft of the motor, and the first driving pulley and the second driving pulley are firmly jointed with the first rotating shaft, and the second driven pulley is jointed with the second rotating shaft, and the compressing pulley is jointed with the third rotating shaft, and the first belt is stretched over the first driving pulley and the first driven pulley, and the second belt is stretched over the second driving pulley and the second driven pulley, and the compressing pulley compresses a side of the stretched second belt.

2. The gluing mechanism of claim 1, further comprising a vacuum pump, a first pressure control valve, two lockers, two columns and two suction inlets, wherein the two lockers are firmly jointed with the first rotating shaft and the second rotating shaft respectively, and the two columns are movably jointed with the two lockers respectively, and one end of each suction inlet is fixed with one column, and the other end is connected to the vacuum pump and the first pressure control valve is firmly connected to the vacuum pump.

3. The gluing mechanism of claim 1, further comprising a base plate fixed on the platform, having a sliding track, and the forward assembly comprises a substrate, a standing plate, a sliding block, a first joint block, a second joint block, an elastic element, a bolt and a bolt fix block, wherein one side of the substrate is fixed with the sliding block and the first joint block, and the other side of the substrate is fixed with the standing plate, and the bolt fix block is fixed on the base plate, and one end of the bolt is screwed through the bolt fix block to be jointed with the first joint block, and one end of the elastic element presses against the first joint block and the other end of the elastic element presses against the second joint block, and the sliding block slidably joints the base plate with the sliding track, and the elevator joints with the standing plate vertical to the platform.

4. The gluing mechanism of claim 3, wherein the elevator further comprises a cylinder base, a cylinder, a second pressure control valve, a middle plate and a slide plate, wherein the cylinder base is fixed on the standing plate, and the cylinder is firmly installed on the cylinder base vertical to the platform, and the second pressure control valve is firmly connected to the cylinder, and the cylinder base has a guide parallel with the cylinder, and the middle plate is firmly connected to the piston rod of the cylinder, and one end of the slide plate is firmly connected with the middle plate and a side of the slide plate facing the cylinder base has a first slideway, and the first slideway of the slide plate matches with the guide to allow the slide plate slide on the cylinder base along the guide.

5. The gluing mechanism of claim 4, wherein the other end of the slide plate away from the cylinder has a stopper, and one end of the cylinder base away from the cylinder has an upper block and a lower block for limiting the movement of the stopper.

6. The gluing mechanism of claim 4, wherein the panning assembly comprises a glue applicator conveyer, two upper fix blocks, two lower fix blocks, two connection columns, two adjustment bases and two adjustment bolts, wherein one side of the glue applicator conveyer is firmly jointed with the slide plate and the other side of the glue applicator conveyer has a second slideway and a third slideway parallel with each other horizontally, and two ends of each connection column are fixed with one upper fix block and one lower fix block, and the upper fix blocks and the lower fix blocks slidably joint with the glue applicator conveyer along the second slideway and the third slideway, and the two adjustment bases are firmly set at two sides of the glue applicator conveyer respectively, and the adjustment bolts are screwed through the adjustment bases and one end of each adjustment bolt is fixed with one connection column, and the glue applicators are through the upper fix blocks and the lower fix blocks to be set therebetween.

7. The gluing mechanism of claim 6, wherein the panning assembly comprises further comprises two fix bolts screwed through the upper fix blocks and one end of each fix bolt presses against the glue applicator.

8. The gluing mechanism of claim 1, further comprising a reducer, electrically connected to the motor.

9. The gluing mechanism of claim 1, further comprising a rotation sensor and a controller, wherein the rotation sensor is rotatably jointed with an output shaft of the motor and the rotation sensor, the motor are electrically connected to the controller.

10. A gluing mechanism, applied in a rotary gluing process, comprising:

a platform;

a plurality of turn tables, set on the platform for workpieces;

a motor, driving the turn tables; and a gluing device, firmly set up on the platform and having a forward assembly, an elevator, a panning assembly and a plurality of glue applicators; and a base plate fixed on the platform, having a sliding track, and the forward assembly comprises a substrate, a standing plate, a sliding block, a first joint block, a second joint block, an elastic element, a bolt and a bolt fix block, wherein one side of the substrate is fixed with the sliding block and the first joint block, and the other side of the substrate is fixed with the standing plate, and the bolt fix block is fixed on the base plate, and one end of the bolt is screwed through the bolt fix block to be jointed with the first joint block, and one end of the elastic element presses against the first joint block and the other end of the elastic element presses against the second joint block, and the sliding block slidably joints the base plate with the sliding track, and the elevator joints with the standing plate vertical to the platform;

wherein the forward assembly is set on the platform and moves along a shorter side of the platform, the elevator is set on the forward assembly and moves relative to the platform vertically, the panning assembly is set on the elevator and moves along a longer side of the platform, the glue applicators of the gluing device are installed on the panning assembly and the motor drives the turn tables simultaneously.

* * * * *